US006533951B1

(12) United States Patent
Debar et al.

(10) Patent No.: US 6,533,951 B1
(45) Date of Patent: Mar. 18, 2003

(54) METHOD OF MANUFACTURING FLUID PUMP

(75) Inventors: Michael Debar, Berkeley, CA (US); Constantine N. Anagnostopoulos, Mendon, NY (US); Gilbert A. Hawkins, Mendon, NY (US); Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 23 days.

This patent is subject to a terminal disclaimer.

(21) Appl. No.: 09/626,874

(22) Filed: Jul. 27, 2000

(51) Int. Cl.[7] ..... H01L 21/00

(52) U.S. Cl. ..... 216/27; 216/77; 216/79; 216/2; 216/99; 216/102; 137/147; 137/565.11; 137/565.32; 417/51; 417/54; 417/55

(58) Field of Search ..... 216/2, 17, 27, 216/75, 77, 79, 99, 102; 137/147, 282, 454.4, 565.01, 565.11, 565.32; 417/51, 53, 54, 55

(56) References Cited

U.S. PATENT DOCUMENTS 4,478,211 A * 10/1984 Haines et al. ..... 126/590
4,908,679 A 3/1990 Vora et al.
5,224,843 A 7/1993 Van Lintel
5,300,444 A 4/1994 Hachisuka et al.
5,346,372 A * 9/1994 Naruse et al. ..... 251/11
5,351,488 A * 10/1994 Sorensen ..... 126/635
5,362,213 A 11/1994 Komatsu et al.
5,380,396 A * 1/1995 Shikida et al. ..... 118/728
5,499,409 A 3/1996 St. Clair
5,507,601 A * 4/1996 Taguchi ..... 406/120
5,578,526 A 11/1996 Akram et al.
5,683,650 A * 11/1997 Morando ..... 266/112
5,686,789 A * 11/1997 Schoenbach et al. ..... 313/491
5,855,801 A * 1/1999 Lin et al. ..... 216/2
5,890,745 A 4/1999 Kovacs
5,907,791 A 5/1999 Cappuzzo et al.
6,097,406 A * 8/2000 Lubinsky et al. ..... 347/15
6,146,543 A * 11/2000 Tai et al. ..... 216/2
6,237,619 B1 * 5/2001 Maillefer et al. ..... 137/15.18

* cited by examiner

*Primary Examiner*—Randy Gulakowski
*Assistant Examiner*—J Smetana
(74) *Attorney, Agent, or Firm*—Walter S. Stevens; Norman Rushefsky

(57) ABSTRACT

A method of manufacturing a pump [10] for pumping various primary fluids. A body is formed from silicon dies [102,104]. A primary fluid channel [110] is formed in the body and a primary fluid supply [122] is coupled to the primary fluid channel [110] to supply a primary fluid to the primary fluid channel [110]. A mechanism for introducing a secondary fluid to an interface region of the primary fluid channel [110] is formed in the body. An energy delivery device is formed in the body to deliver energy to an interface between region between the primary fluid and the secondary fluid to create a thermal gradient along the fluid interface. The thermal gradient results in a surface tension gradient along the interface. The primary fluid will move to compensate for the surface tension gradient. Various semiconductor fabrication processes can be used to form the elements on the body.

13 Claims, 13 Drawing Sheets

METHOD OF MANUFACTURING FLUID PUMP

FIELD OF THE INVENTION

The present invention relates generally to pumping devices, and more particularly to a method of manufacturing a fluid pump, such as a microscale fluid pump, using semiconductor fabrication techniques

BACKGROUND OF THE INVENTION

It is well known to utilize microscale fluid pumps to pump various fluids. The term "microscale," as used herein, refers to an apparatus or method using a minimum amount of fluid to effectively perform a function. Many microscale pumps incorporate thermal technology, whereby heat is used to move the fluid. For example, in a bubble jet printer ink in a channel is heated to a boil to create a bubble until the pressure ejects a droplet of the ink out of a nozzle. The bubble then collapses as the heating element cools, and the resulting vacuum draws fluid from a reservoir to replace the fluid that was ejected from the channel. Thermal technology requires that the fluid to be pumped be resistant to heat, i.e. capable of being boiled without significant breakdown. Also, the need for a cooling period between ejecting successive droplets from a nozzle places speed limitations on thermal microscale pumps.

Piezoelectric microscale pumps, such as that disclosed in U.S. Pat. No. 5,224,843, have a piezoelectric crystal in the fluid channel that flexes when an electric current flows through it to force a drop of fluid out of a nozzle. Piezoelectric technology is faster and provides more control over the fluid movement as compared to thermal technology. Also, because the fluid to be pumped is not heated significantly, the fluid can be selected based on its relevant properties rather than its ability to withstand high temperatures. However, piezoelectric microscale pumps are complex and thus expensive to manufacture. U.S. Pat. Nos. 5,362,213 and 5,499,409 disclose microscale pumps having movable parts. Such pumps are relatively complex and required high maintenance.

Further, microscale fluid pumps find use in various other applications in which a high degree of control is required and high temperatures are to be avoided. For example, microscale fluid pumps can be used in biological heat-pipe type devices, devices which administer small doses of fluid into a larger stream of fluid, devices which pump various solutions that are unstable when boiled, devices which pump biological materials and other materials that must be maintained at a constant temperature, and other generic pumping applications. Accordingly, there is a need for a microscale fluid pump that is simple in construction and capable of pumping fluid quickly and accurately without boiling the fluid. Further, there is a need for a microscale fluid pump design and manufacturing method that easily can be manufactured using semiconductor fabrication techniques.

It is known to utilize semiconductor manufacturing technology to form devices having fluid channels, For example, U.S. Pat. No. 5,890,745 discloses a fluid coupler that includes a fluid channel formed by etching a semiconductor wafer. However, the fluid coupler disclosed in this patent has no mechanism for moving fluid and merely serves as a conduit between fluid systems.

SUMMARY OF THE INVENTION

An object of the invention is to increase the control accuracy of microscale fluid pumps by employing precision semiconductor manufacturing techniques.

Another object of the invention is to simplify the construction of microscale fluid pumps.

Another object of the invention is to utilize semiconductor fabrication techniques to manufacture a fluid pump.

Another object of the invention is to utilize standard CMOS processes to manufacture a microscale fluid pump.

Another object of the invention is to impart motion to fluid without the need for moving parts or boiling of the fluid.

Another object of the invention is to reduce the power required by microscale fluid pumps.

The invention achieves these and other objects through a first aspect of the invention which is a method for manufacturing a fluid pump comprising the steps of defining a primary fluid channel in a body, forming a primary fluid aperture in communication with the primary fluid channel, forming a mechanism on the body for introducing a secondary fluid to an interface region of the primary fluid channel, and forming an energy delivery device proximate the interface region.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

Figure 1:
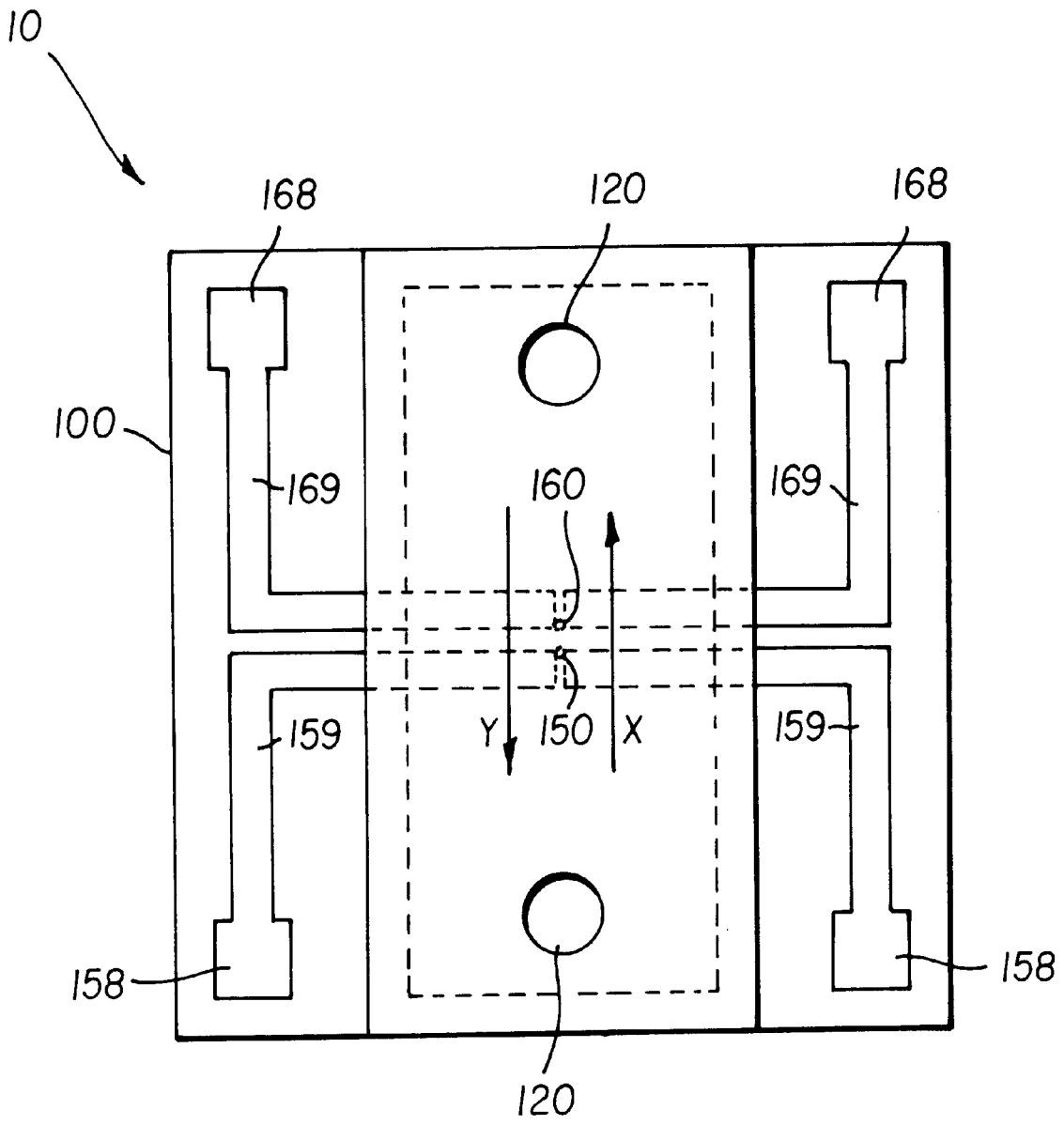
FIG. 1 is a top view of a pump in accordance with a first preferred embodiment of the invention with portions rendered transparent.
Figure 2:
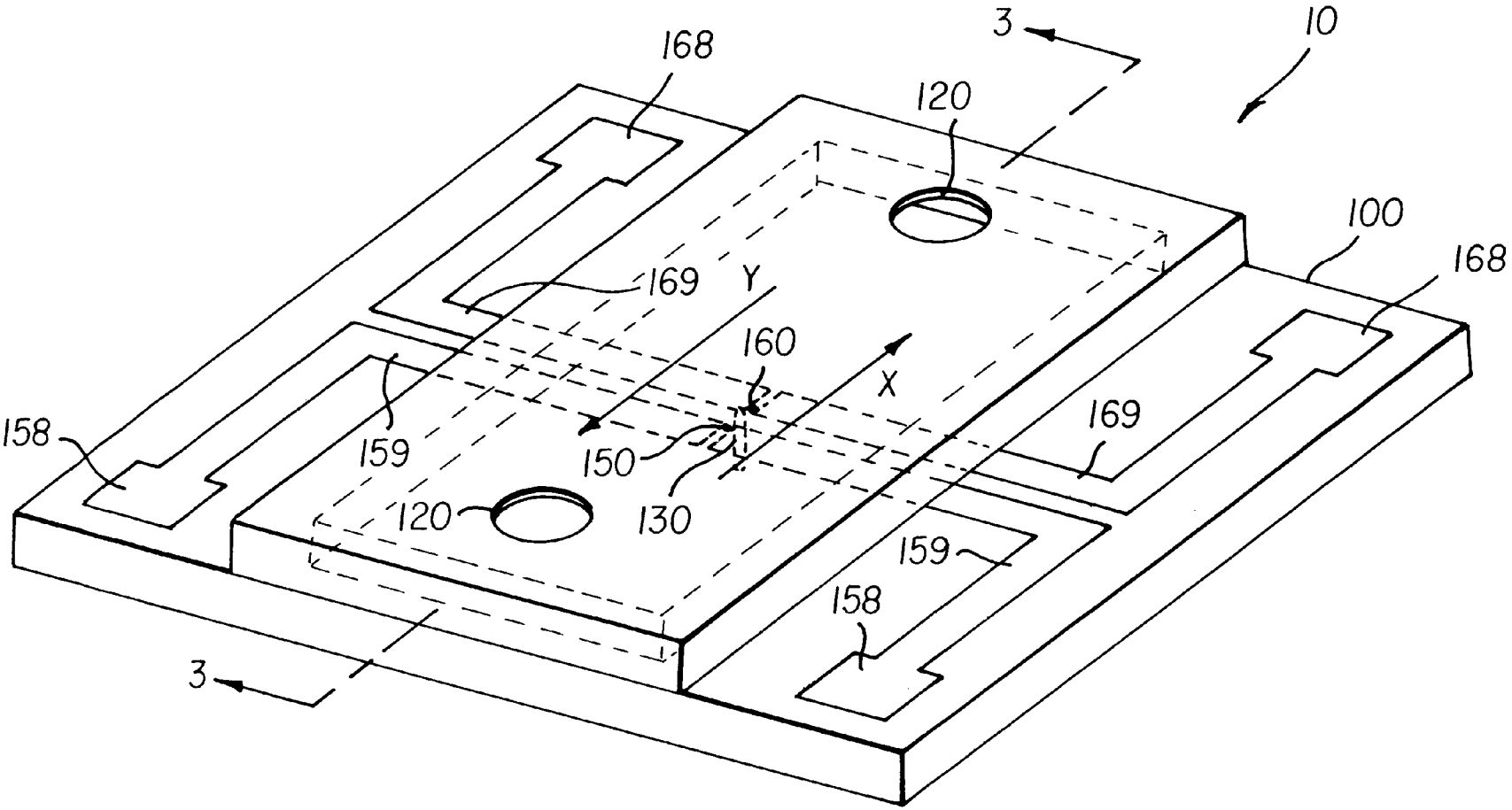
FIG. 2 is a perspective view of the pump of FIG. 1.

FIGS. 1–4 illustrate a first preferred embodiment of the invention. The preferred embodiment is formed from a silicon substrate using known semiconductor fabrication techniques as described in detail below. However, the invention can be formed of various materials using various fabrication techniques. Microscale pump 10 includes silicon substrate 100 (serving as a pump body) having primary fluid channel 110 formed therein, through an etching process or the like. Primary fluid ports 120 communicate with primary fluid channel 110. One of primary fluid ports 120 can be coupled to supply 122 of primary fluid to be pumped (as illustrated schematically by the dotted line in FIG. 3) and the other of primary fluid ports 120 can be coupled to a nozzle or any other orifice, channel, or the like through which fluid is to be ejected or otherwise transported. As will become apparent below, microscale pump 10 can be operated in either a forward or reverse direction and thus primary fluid ports 120 are interchangeable with one another.

Figure 3:
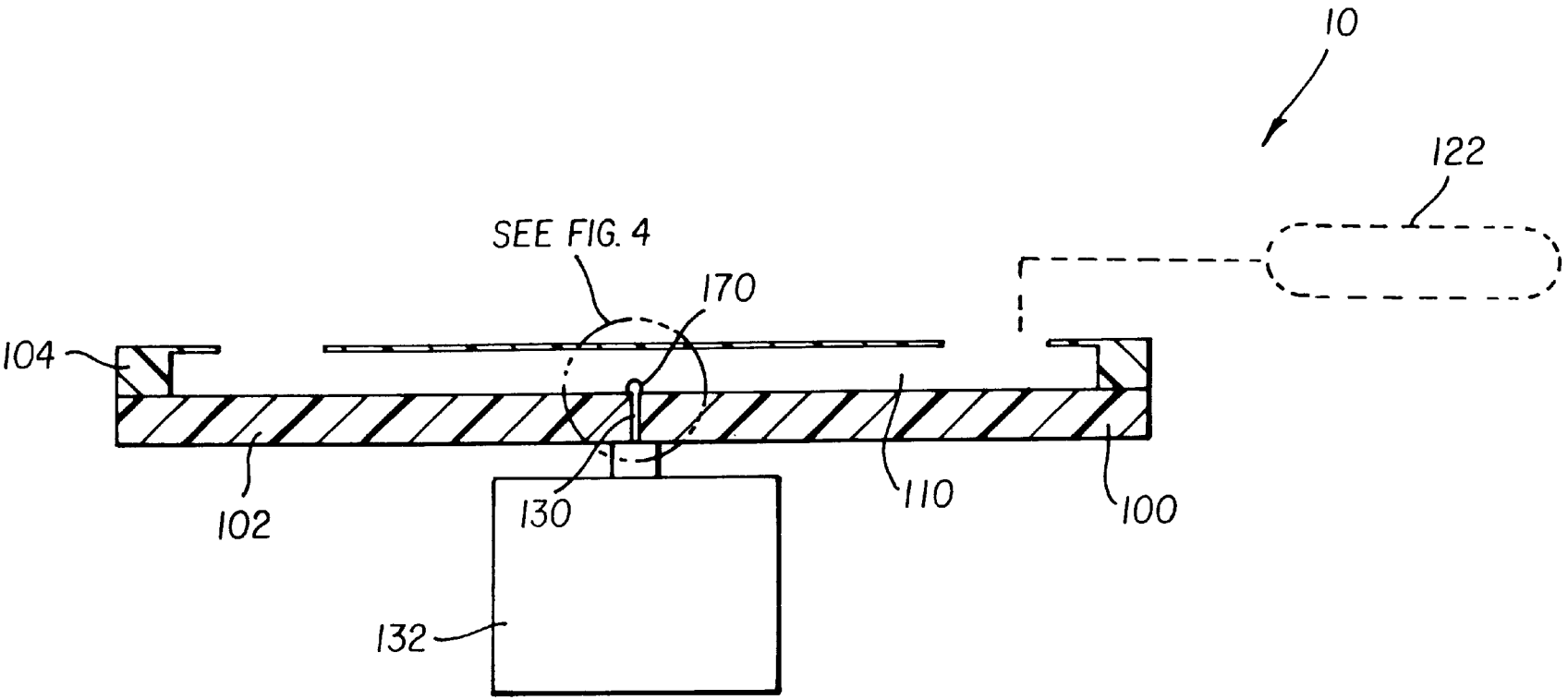
FIG. 3 is a sectional view taken along line 3—3 of FIG. 1.
Figure 4:
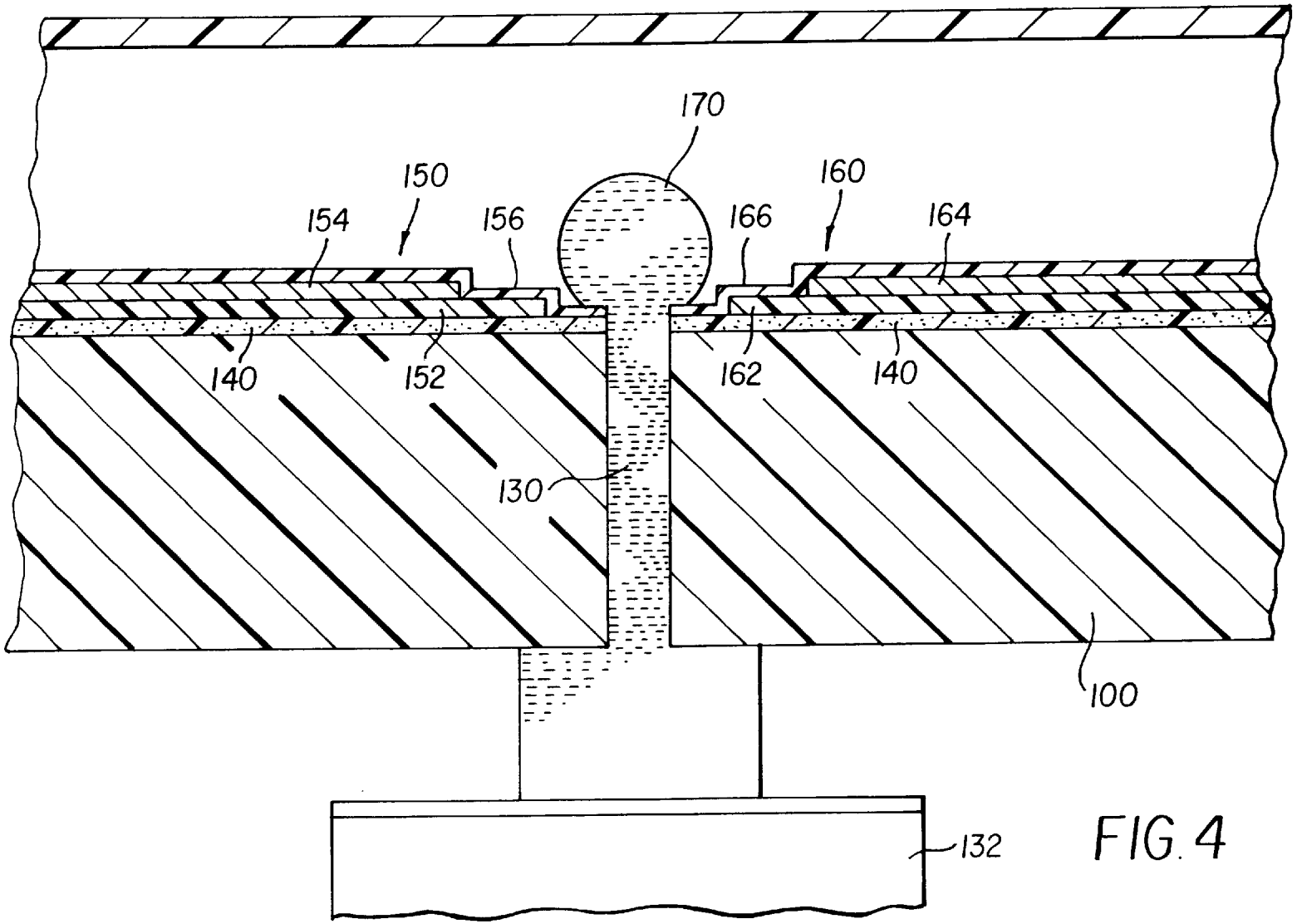
FIG. 4 is an enlarged view of portions of FIG. 3.

As best illustrated in FIGS. 3 and 4, secondary fluid channel 130 is formed in substrate 100 in communication with an interface region of primary fluid channel 110. Secondary fluid channel 130 is coupled to external supply 132 of a secondary fluid, such as a pressurized supply of nitrogen, hydrogen, air or oxygen. Secondary fluid channel 130 and external supply 132 are operative to introduce the secondary fluid to the interface region of primary fluid channel 110. The secondary fluid is used to create a fluid interface with the primary fluid, as described in detail below, and preferably is not pumped by microscale pump 10.

As illustrated in FIG. 4 a first insulating layer, such as a thermal oxide layer 140, is grown on a surface of substrate 100 using techniques described below. Heating elements 150 and 160 are formed on insulating layer 140 respectively at opposing sides of the interface region of primary fluid channel 110. Heating elements 150 and 160 can include resistive elements and can each comprise doped polysilicon layer 152/162 deposited on thermal oxide layer 140 and aluminum layers 154/164 formed thereon to serve as an electrical conductor. As illustrated in FIG. 1, aluminum layer 154 defines contact pads 158 and conductor 159 and aluminum layer 164 defines contact pads 168 and conductor 169. Accordingly, electric power can be supplied to the resistive elements of heating elements 150 and 160 to generate heat at the interface region. Silicon dioxide layer 156/166 can be formed as a second insulating layer to insulate the other components the manufacturing method of the first preferred embodiment is discussed in detail below.

During operation of microscale pump 10, a primary fluid to be pumped is supplied to primary fluid channel 110 through one of primary fluid ports 120. Further, a relatively small metered amount of a secondary fluid, such as a gas, is introduced into the interface region of primary fluid channel 110 through secondary fluid channel 130 to form bubble 170 of the secondary fluid as illustrated in FIGS. 3 and 4. A fluid interface is thus defined between the primary fluid and the secondary fluid in the interface region of primary fluid channel 110. In this state, contact pads 158 and 168 can be coupled to a source of electric power that is controlled in a desired manner to selectively supply current to one of heating elements 150 or 160. For example, when electric current is supplied to heating element 150, through contact pads 158 and conductor 159, heating element 150 generates heat at one side of the interface region. Accordingly, a temperature gradient is defined in the interface region along the interface between the primary fluid and the secondary fluid. Since the surface tension between two dissimilar fluids is dependent on the temperature at the interface of the fluids, a surface tension gradient is formed along the fluid interface. The primary fluid will naturally move in the direction of decreasing temperature, i.e. the direction indicated by arrow x in FIGS. 1 and 2, to compensate for the surface tension gradient. Accordingly, motion is imparted to the primary fluid in response to activation of heating element 150. Heating element 160 can be activated in a similar manner to move the primary fluid in the direction of arrow y. Further, heating elements 150 and 160 can be activated together or separately to varying degrees to precisely control the temperature gradient along the fluid interface and thus precisely control movement of the primary fluid.

Figure 5:
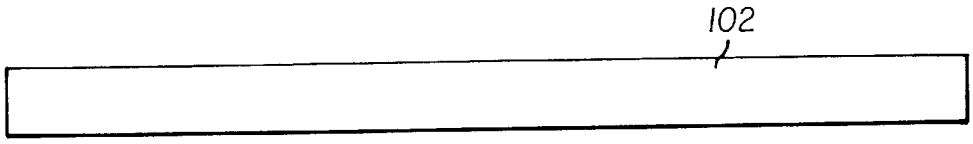
FIGS. 5–13 illustrate the steps of manufacturing a first die of the first preferred embodiment.
Figure 6:
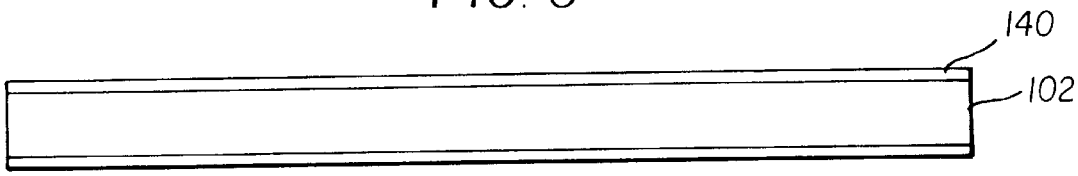

The method of manufacturing the first preferred embodiment will be described in detail below with respect to FIGS. 5–21. The preferred embodiment is comprised of two dies and each die is processed simultaneously with other dies as part of a respective wafer which is subsequently cut into plural dies, as is well known. However, for the sake of clarity, only one die of the wafer is illustrated and discussed. Accordingly, the various layers and films are not illustrated on the sides of each die because the die is processed as part of a larger wafer. Also, the term "die, as used herein, refers to any body place, such as a wafer, portion of a wafer, or the like. Specifically substrate 100 can be comprised of first die 102 and second die 104 (see FIG. 3), made of silicon for example. Dies 102 and 104 can be processed separately and subsequently joined together through a bonding process or the like. Beginning with die 102 as bare silicon illustrated in FIG. 5, thermal oxide layer 140 is grown thereon, as illustrated in FIG. 6 for the purpose of insulating the electronics from the silicon beneath. For example a steam oxidation process can be performed at 1100° C., for 240 minutes. This process will yield about 1.3 microns of oxide, i.e. thermal oxide layer 140 will be about 1.3 microns thick. However, 2000–3000 angstroms of oxide is adequate to insulate the silicon from the electronics. The additional thickness of thermal oxide layer 140 allows for possible degradation or damage during later processes.

Figure 7:
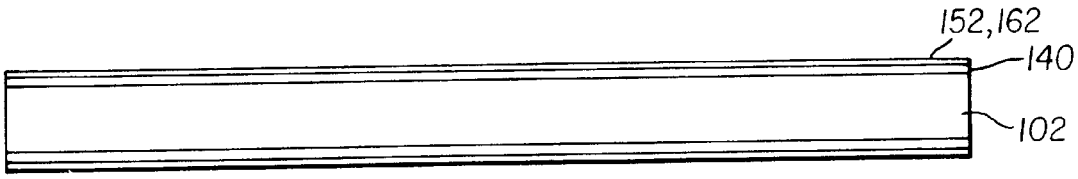

Next, as illustrated in FIG. 7, doped polysilicon layer 152/162 of polysilicon is deposited on thermal oxide layer 140 using a low pressure chemical vapor deposition (LPCVD) process. Polysilicon layer 152/162 can be n-doped or p-doped. For example the LPCVD process can be conducted for 120 minutes at 610° C. This recipe will yield polysilicon layer 152/162 of about 3000 angstroms in thickness on both faces of die 102. The next step is to anneal polysilicon layer 152/162 to reduce the resistively thereof to about 25 ohms/mm$^2$ (about a factor of ten difference with respect to the polysilicon layer 152/162 prior to annealment). The annealment step can be accomplished by heating die 102 in a nitrogen environment at 1 atmosphere and 900° C. for about one to two hours.

Figure 8:
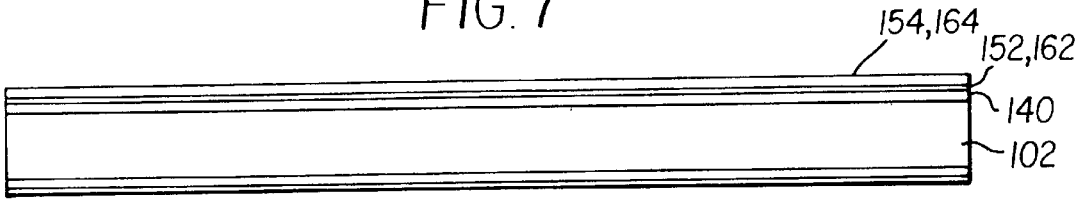
Figure 9:
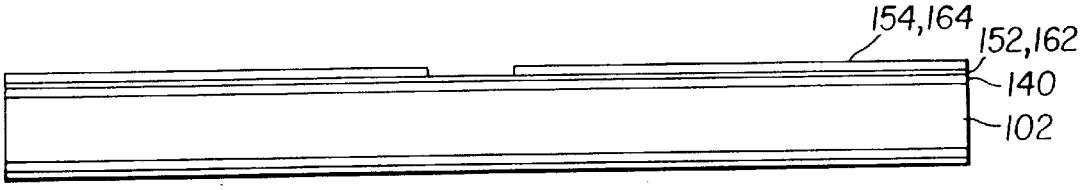

Next, as illustrated in FIG. 8, pads 158/168 and conductors 159/169 can be formed by sputtering aluminum layer 154/164 on polysilicon layer 152/162, on the top face of die 102. A photoresist lithography process can be used to etch the pattern of pads 158/168 and conductors 159/169. For example, wafer 102 can be dehydrated and coated with HMDS (Hexamethyldisilazane) to facilitate adhesion between aluminum layer 154/164 and the subsequent photoresist layer. A photoresist layer can then be coated on aluminum layer 154/164 and spun to about 1.2 microns in thickness. The layer can be soft baked for about 60 seconds at 90° C., exposed, developed, and hard bake for about 45 minutes at 120° C. A wet etch process can be used until portions of aluminum layer 154/164 beneath the exposed areas are removed to form the desired patterns in aluminum layer 154/164. Subsequently, the photoresist layer can be stripped and die 102 can be cleaned in de-ionized water to yield the pattern illustrated in FIG. 9. Of course since FIG. 9 is in cross section, the entire pattern is not visible. However, FIGS. 1 and 2 above illustrate the pattern more clearly. Note that, polysilicon layer 152/162 on the front and back of die 102 will be exposed to the aluminum etchant but will not be removed or otherwise affected thereby.

Figure 10:
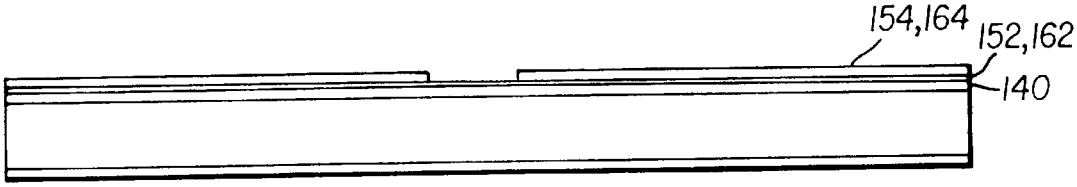

Next, polysilicon layer 152/162 is patterned into resistive elements (leaving conductors 159/169 and pads 158 and 168) using a similar photolithography process as that described above. In particular, a zig-zag or other pattern can be formed of polysilicon layer 152/162 to form resistive heating elements. The etching process will stop at thermal oxide layer 140 but polysilicon layer 152/162 on the back face will be removed in the wet etch bath as illustrated in FIG. 10. The photoresist can then be stripped and die 102 can be cleaned.

Figure 11:
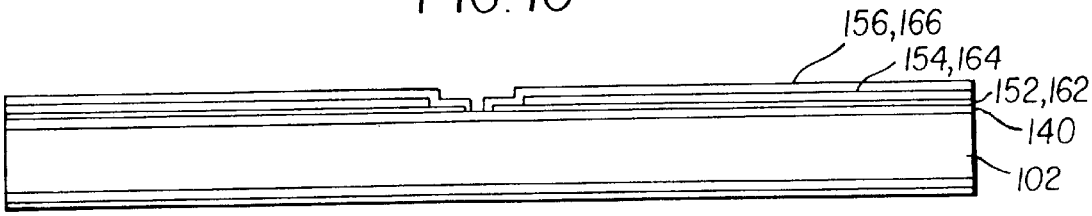
Figure 12:
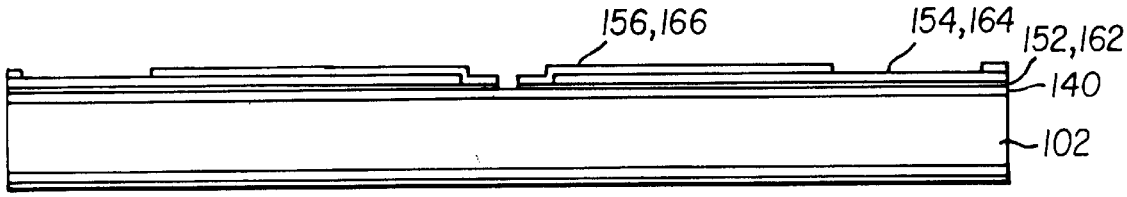
Figure 13:
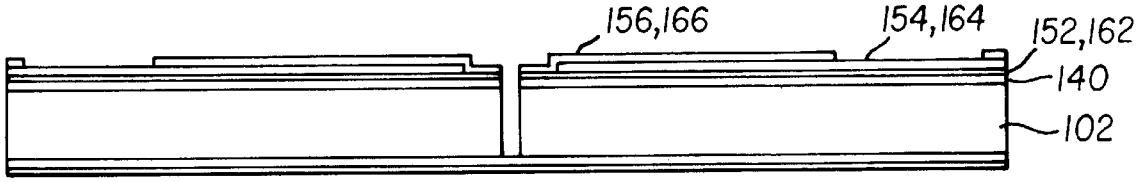
Figure 14:
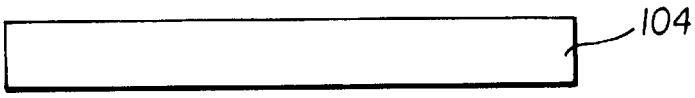
FIGS. 14–19 illustrate the steps of manufacturing a second die of the first preferred embodiment.

Next, the electrical components are insulated with silicon dioxide layer 156/166 deposited with an LPCVD process to a thickness of about 3000 angstroms, as illustrated in FIG. 11. Both faces of die 102 are subject to the LPCVD process to form a conformal layer that will follow the existing contours formed by the etching steps discussed above, as illustrated in FIG. 11. Holes are then formed in silicon dioxide layer 156/166 to remove the insulation from contact pads 158/168 and from the surface where the bulk silicon must be etched to form secondary fluid channel 130 as illustrated in FIG. 12. A plasma etching process can be accomplished in a reactive ion etcher (RIE) so only the top side is etched to form secondary fluid channel 130, as illustrated in FIG. 13. In particular, a thick lithography process can be used to pattern the hole and thermal oxide layer 140 can be etched using the RIE process. The same photoresist layer can be used in an inductively coupled plasma (ICP) etching process to get an anisotropic etch all the way through die 102 (this typically requires the attachment of a wafer to the back side of the device wafer to prevent damage to the etcher when the hole though die 102 is completed). The thin membrane of thermal oxide on the back side can be etched, but will be broken by the pressure from the external supply 132 if it is not ruptured during etching.

Figure 15:
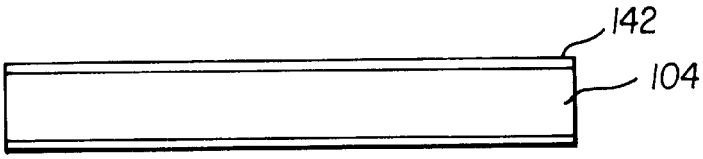
Figure 16:
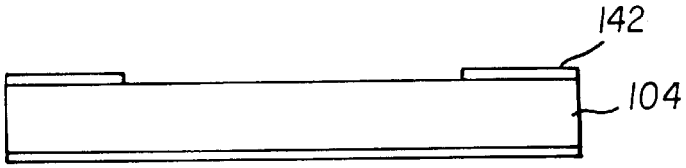

Second die 104 of the preferred embodiment is formed in the following manner with reference to FIGS. 14–19. Thermal oxide layer 142 is grown on silicon die 104 (see FIG. 14) as a masking layer as illustrated in FIG. 15. For example a steam oxidation process at 1100° C. for 240 minutes will yield thermal oxide layer 142 of about 1.3 microns in thickness. Primary fluid channel 110 is then patterned in oxide layer 142, as illustrated in FIG. 16, using the standard lithography process disclosed above. The photoresist is then stripped and wafer 104 is cleaned.

Figure 17:
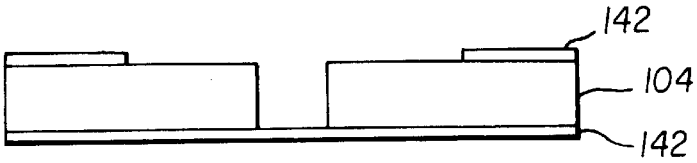
Figure 18:
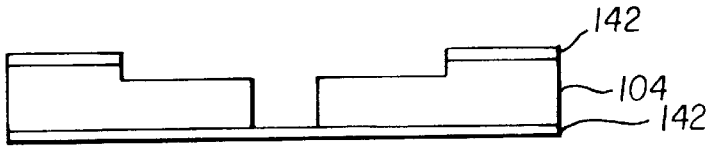
Figure 19:
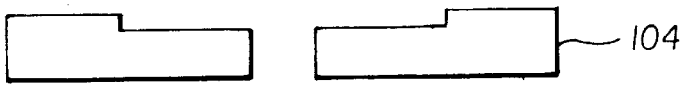
Figure 28:
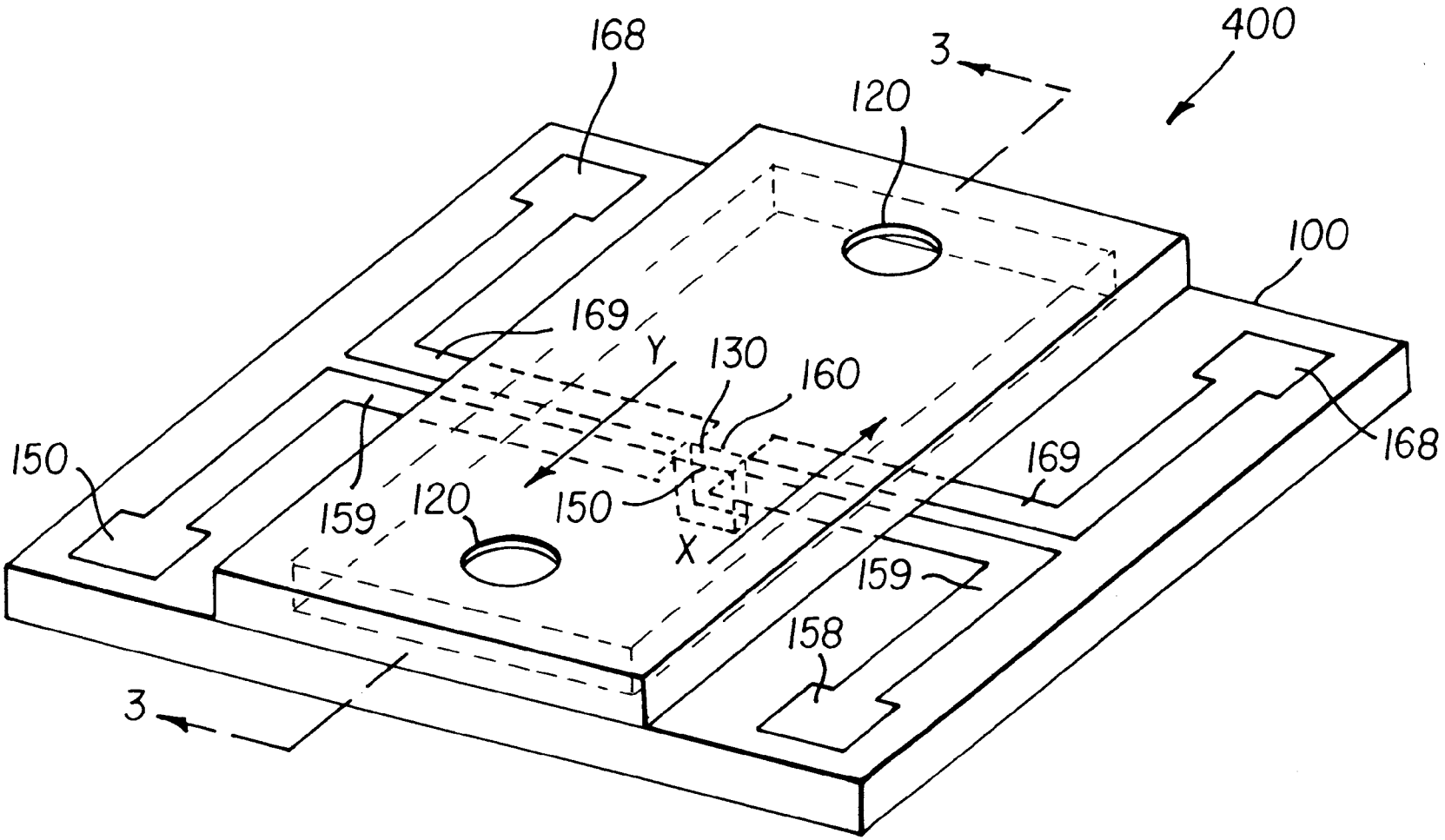
FIG. 28 is a perspective view of a pump in accordance with a fourth preferred embodiment of the invention.

As illustrated in FIG. 17, fluid ports 120 are patterned in the silicon after oxide has been selectively removed from these portions of die 104 using the photo resist step disclosed above. The photoresist is then stripped and die 104 is cleaned again. An RIE process can be used to etch primary fluid channel 110 to a specified depth, e.g. 100 micrometers, using oxide layer 142 as a mask, as illustrated in FIG. 28. Subsequently, oxide layer 142 can be stripped by submersing die 104 in hydrofluoric acid until hydrophobic, as illustrated in FIG. 19 (this step can be omitted if the oxide layer is desirable in the bonding process as discussed below).

Figure 20:
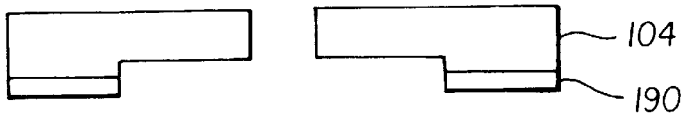
FIGS. 20 and 21 illustrate a first preferred procedure of bonding the first and second dies of the first preferred embodiment.
Figure 21:
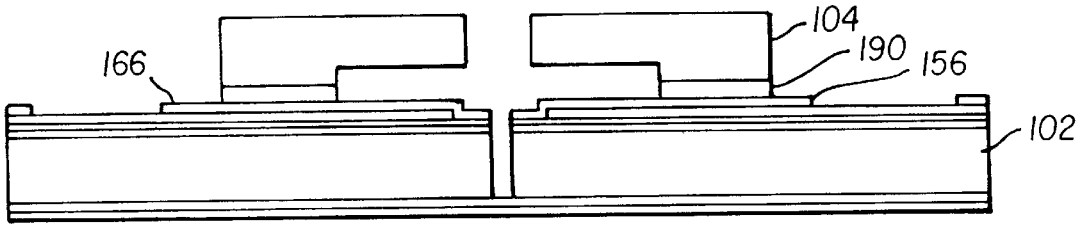
Figure 22:
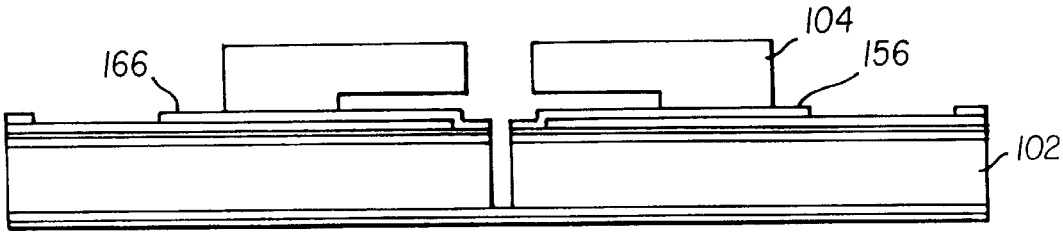
FIG. 22 illustrates a second preferred procedure of bonding the first and second dies of the first preferred embodiment.
Figure 23:
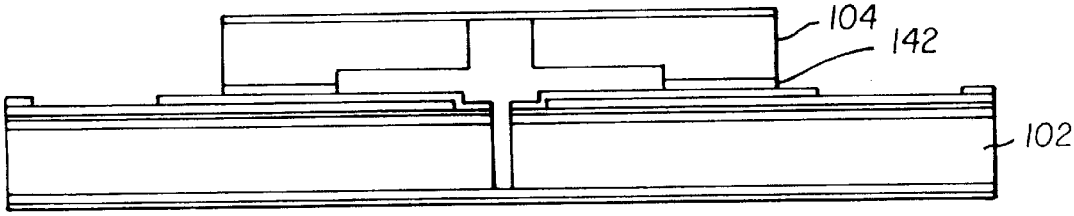
FIG. 23 illustrates a third preferred procedure of bonding the first and second dies of the tint preferred embodiment.

Dies 102 and 104 are bonded to form substrate 100 in the following manner. First, epoxy layer 200 is spread onto one of dies 102 and 104, as illustrated in FIG. 20. Dies 102 and 104 are then aligned and held under pressure to form a bond as epoxy layer 190 cures, as illustrated in FIG. 21. Alternatively, dies 102 and 104 can be aligned and placed under pressure while being heated to a moderate temperature (preferably below 500° C. to avoid melting the aluminum) to form a fusion bond as illustrated in FIG. 22. Further, as illustrated in FIG. 23, oxide layer 142 can be left on the lower surface of die 104 and fusion can be accomplished between oxide layer 142 and silicon dioxide layer 156/166.

Figure 24:
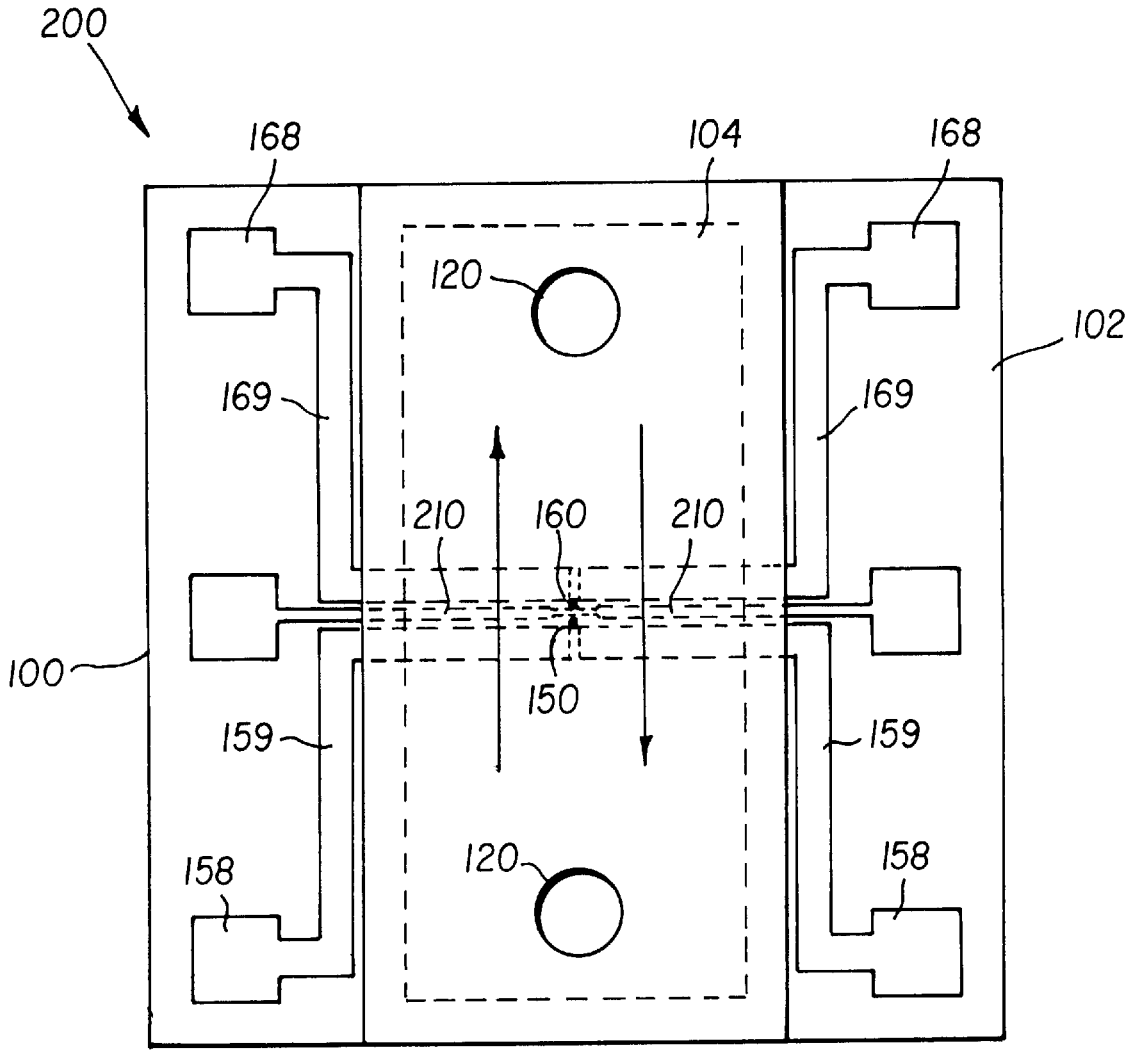
FIG. 24 is a top view of a pump in accordance with a second preferred embodiment of the invention with portions rendered transparent.
Figure 25:
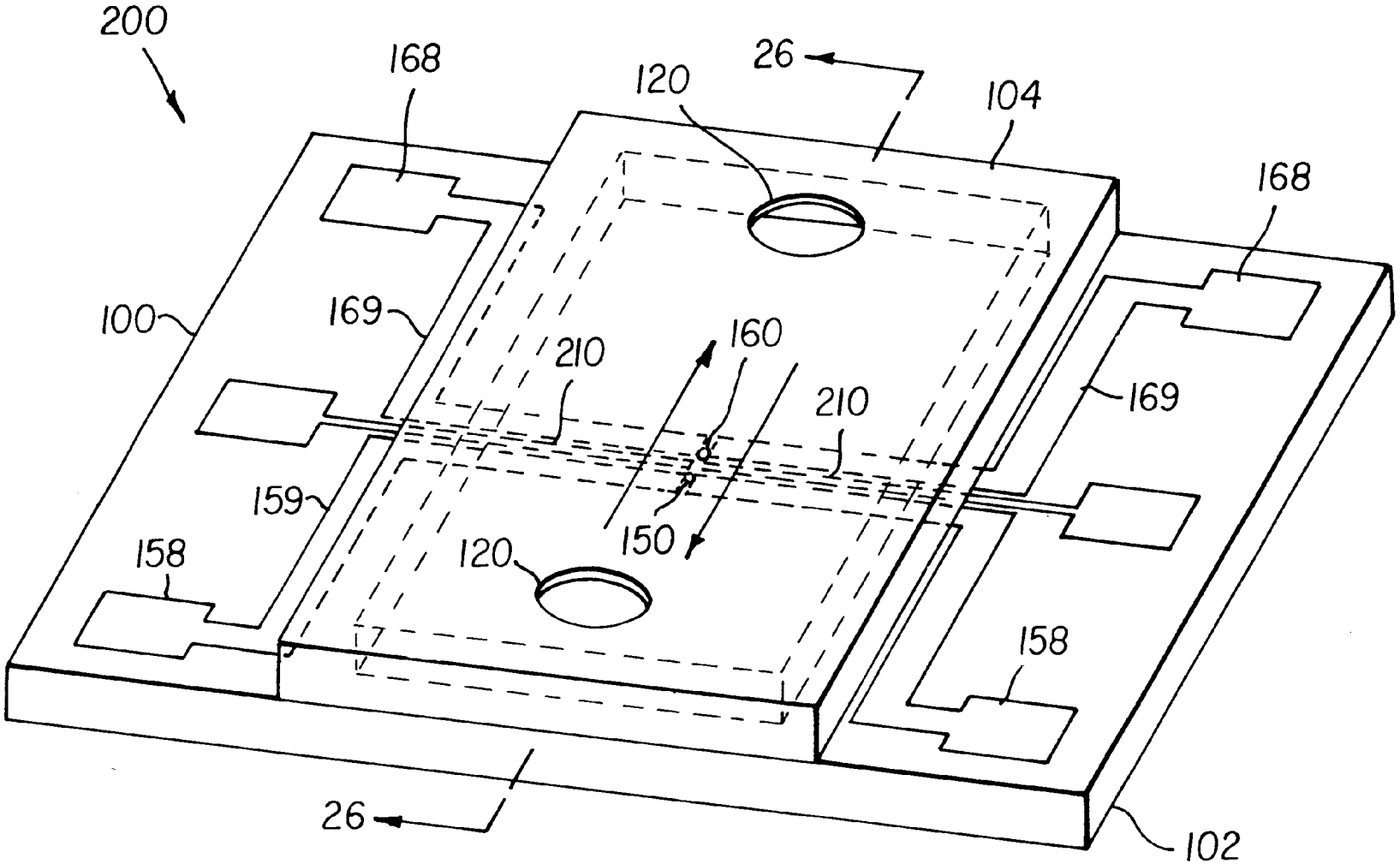
FIG. 25 is a perspective view of the pump of FIG. 24.
Figure 26:
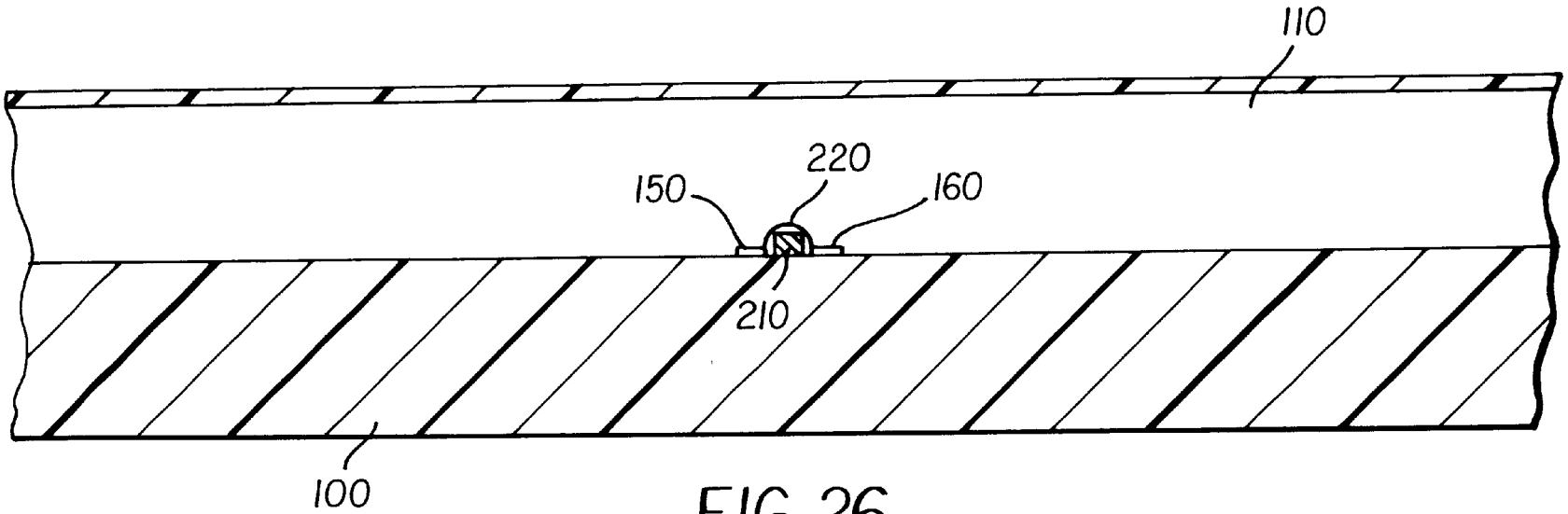
FIG. 26 is an enlarged sectional view taken along line 26—26 of FIG. 25.

FIGS. 24–26 illustrate a second preferred embodiment of the invention. Microscale pump 200 is similar to microscale pump 10 of the first preferred embodiment. However, microscale pump 200 does not have a secondary fluid channel for introducing a secondary fluid. In microscale pump 200, bubble 220 is formed, i.e. the secondary fluid is introduced, in-situ. In particular, a pair of electrodes 210 are provided proximate an interface region of primary fluid channel 110. Electrodes 210 are coupled to an external source of electric power. After an aqueous fluid is introduced into primary fluid channel 110 as the primary fluid, electrodes 210 can be energized, i.e. an electric potential can be placed across electrodes 210, to thereby dissociate the primary fluid into components of hydrogen and oxygen to form bubble 220 of hydrogen and oxygen in the interface region. Other than the in situ formation of bubble 220, the structure and operation of microscale pump 200 is similar to that of microscale pump 10 and like reference numerals are used to label similar parts in FIGS. 5–7. Any primary fluid can be dissociated or otherwise transformed to form the secondary fluid.

Figure 29:
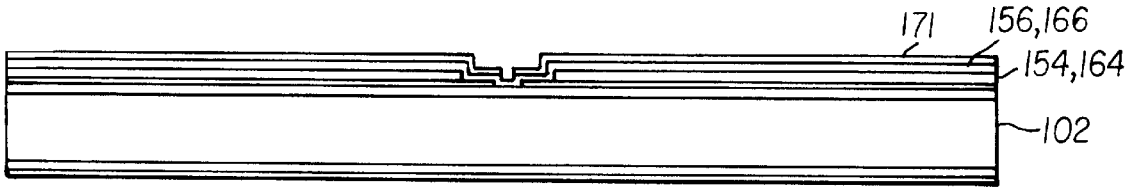
FIGS. 29–33 illustrate the steps of manufacturing a first die of the second preferred embodiment.
Figure 30:
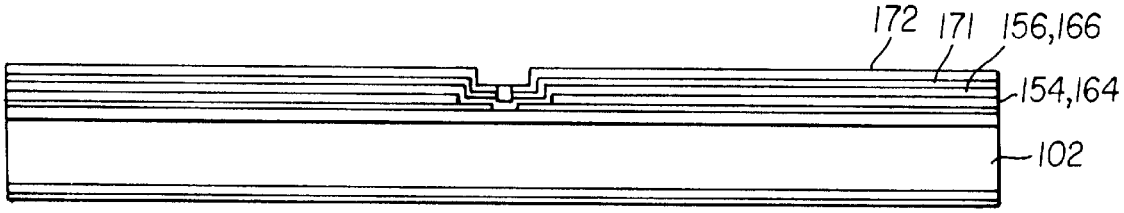
Figure 31:
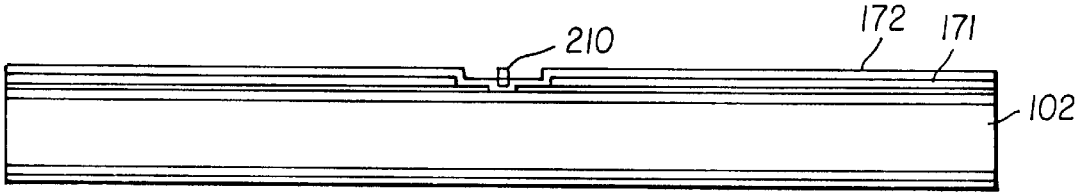
Figure 32:
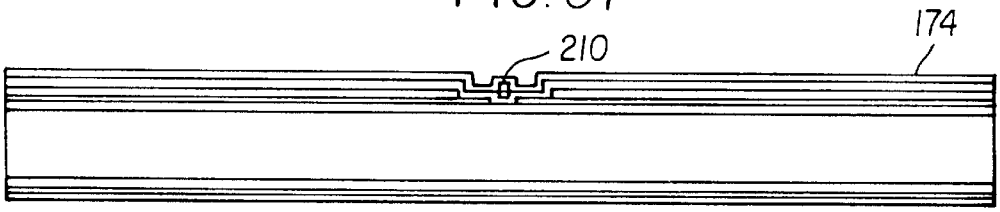
Figure 33:
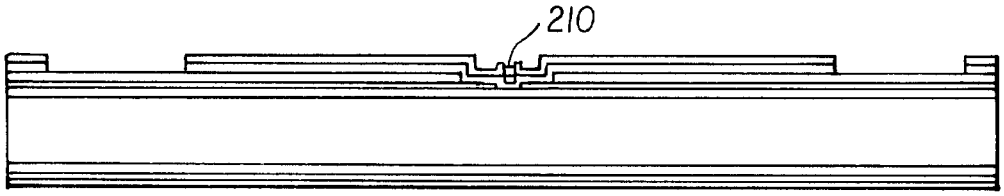

FIGS. 29–33 illustrate the method of manufacturing the second preferred embodiment. First, the steps illustrated in FIGS. 5–11 disclosed above are accomplished in a manner similar to the manufacturing process of the first preferred embodiment. Then, as illustrated in FIG. 29, a photolithography process is used to make a negative of the pattern for electrodes 210 (see FIG. 24) in photoresist layer 171. As illustrated in FIG. 30 platinum layer 172 (or any other appropriate material) can be deposited, through an evaporation process, to about 3000 angstroms thick over photoresist layer 171. Die 102 can then be dipped in acetone for approximately 1 hour to dissolve photoresist layer 171 using a "liftoff process". In such a process, photoresist layer 171 is dissolved away and platinum layer 172 lifts off, except for locations where photoresist layer 171 was not present. This leaves platinum layer 172 only at portions corresponding to electrodes 210 as illustrated in FIG. 31. Subsequently, electrodes 210 can be insulated with oxide layer 174, in a manner similar to the process discussed above, as illustrated in FIG. 32. Oxide layer 174 can then be etched away over contacts and a tip of electrode 210, in a process similar to that described above, as illustrated in FIG. 33. Die 104 of the second preferred embodiment can be manufactured similar to die 104 of the first preferred embodiment and the dies can be bonded in any one of the processes described above with respect to the first preferred embodiment.

Figure 27:
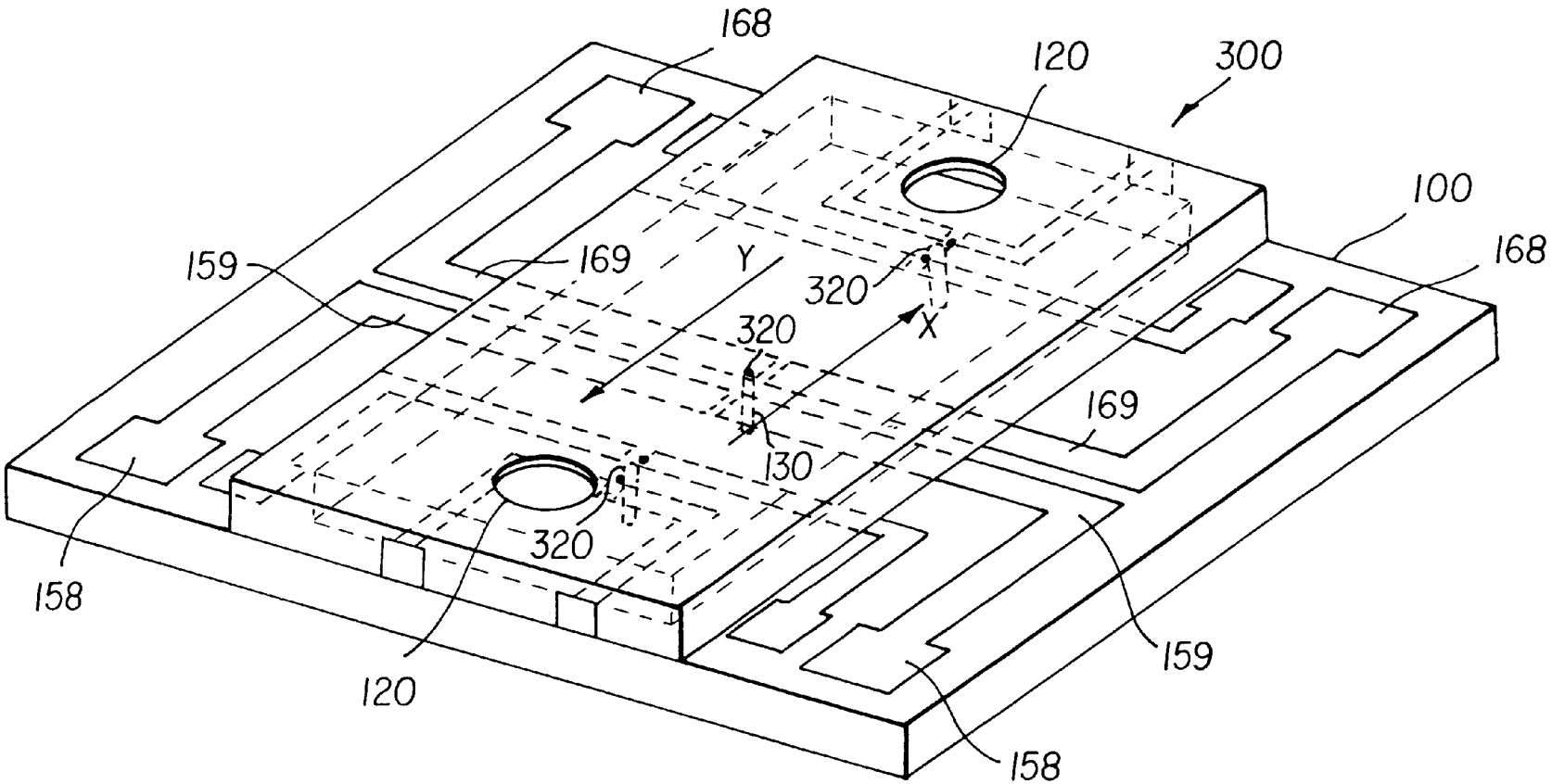
FIG. 27 is a perspective view of a pump in accordance with a third preferred embodiment of the invention.

FIG. 27 illustrates a third preferred embodiment of the invention. Microscale pump 300 is similar to microscale pump 10 of the first preferred embodiment and microscale pump 200 of the second preferred embodiment. However, microscale pump 300 includes plural interface regions each having a mechanism for introducing a secondary fluid, i.e. producing bubble 320. The mechanism for introducing each bubble 320 of secondary fluid can be similar to that of the first preferred embodiment, i.e. external, or the second preferred embodiment, i.e. in-situ. Microscale pump 300 can create a temperature gradient along one or more fluid interfaces and thus a surface tension gradient along one or more interfaces between the primary fluid and the secondary fluid. Each fluid interface can be used to impart motion to the primary fluid in the manner described above. Because the fluid interfaces are in serial relationship with each other along the flow direction, the pressure or flow volume can be increased as compared to a pump having only one interface region.

FIG. 28 illustrates a fourth preferred embodiment of the invention. Microscale pump 400 is similar to microscale pump 10 of first preferred embodiment and microscale pump 200 of second preferred embodiment. However, microscale pump 400 has a slot opening that supports a long secondary fluid interface oriented appropriately to induce flow when heaters or electrodes 150 and 160 are energized. The high aspect ratio secondary fluid interface provides a large surface area that increase the capacity of the pump. The mechanism for introducing a bubble secondary fluid can be similar to that of first preferred embodiment, i.e. external, or the second preferred embodiment, i.e. in-situ. In addition, a plurality of long bubbles may be utilized to create a multiple fluid interface pump described in the third preferred embodiment.

The secondary fluid can be introduced in any manner. As noted above, the bubble of secondary fluid can be formed in situ or through an external fluid supply. Further, the in situ bubble can be formed through a chemical reaction, through electrical dissociation of molecules, through heat, or in any other manner. The primary fluid can be any fluid that is to be pumped, such as a liquid or gas. The secondary fluid can be any fluid that presents an interface with the primary fluid having the desired surface tension and other properties. The secondary fluid can be selected based on the primary fluid, the pump structure, and other considerations of each application. Any mechanism can be used to introduce the secondary fluid. In fact, one pump may have different types of mechanisms for introducing the secondary fluid.

The pump can be constructed using standard CMOS compatible semiconductor fabrication techniques or any other techniques. The pump can be formed using a silicon substrate as a body or using any other type of body in which the necessary channels can be formed. The body can be comprised of one or more pieces. The pump can be of any size and the components thereof can have various relative dimensions. Accordingly, the pump can be a microscale pump or a larger or smaller device. The heating elements can be any type of energy delivery device, such as resistive heaters, radiation heaters, convection heaters, heat pumps (such as Peltier coolers), chemical reaction heaters (endothermic or exothermic), nuclear reaction heaters, or the like. The pump can be controlled in any appropriate manner, such as with a microprocessor based device having a predetermined program. The heating elements can be activated to provide a desired temperature gradient in any manner. For example, the heating elements can be controlled by adjusting the current therethrough or by intermittent activation in a predetermined manner. There can be one heating element or plural heating element. The various layers and coatings can be formed using any process and of any materials. The pump can be applied to pumping of various fluids, such as ink in a print head, biological materials, medicaments, or any other fluids.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

| Reference No. | Description |
|---|---|
| 10 | Microscale Pump |
| 100 | Silicon Substrate |
| 102 | First Die |
| 104 | Second Die |
| 110 | Primary Fluid Channel |
| 120 | Primary Fluid Ports |
| 122 | Primary Fluid Supply |
| 130 | Secondary Fluid Channel |
| 132 | External Supply of a Secondary Fluid |
| 140, 142 | Thermal Oxide Layer |
| 150, 160 | Heating Elements |
| 152, 162 | Polysilicon Layer |
| 154, 164 | Aluminum Layers |
| 156, 166 | Silicon Dioxide Layer |
| 158, 168 | Contact Pads |
| 159, 169 | Conductor |
| 170 | Bubble of Secondary Fluid |
| 171 | Photoresist Layer |
| 172 | Platinum Layer |
| 174 | Oxide Layer |
| 190 | Epoxy Layer |
| 200, 300, 400 | Microscale Pump |
| 210 | Electrodes |
| 220 | Bubble |
| 320 | Bubble of Secondary fluid |

What is claimed is:

1. A method for manufacturing a fluid pump comprising the steps of:

defining a primary fluid channel in a body;

forming a primary fluid aperture in communication with the primary fluid channel;

forming a mechanism on the body for introducing a secondary fluid to an interface region of the primary fluid channel; and forming a thermal energy delivery device proximate the interface region, the thermal energy delivery device being adapted to establish a temperature gradient along the interface region of the primary and secondary fluids without boiling of either fluid whereby the primary fluid will move in a direction of decreasing temperature in response to the temperature gradient at the interface region.

2. A method as recited in claim 1, wherein said step of forming a mechanism comprises forming an elongated slot for defining an elongated fluid interface.

3. A method as recited in claim 1, wherein said steps of defining, forming a primary fluid aperture, forming a mechanism, and forming a thermal energy delivery device each comprise performing semiconductor fabrication steps on the body.

4. A method as recited in claim 3, wherein said body comprises first and second dies that are bonded to each other to form the primary fluid channel between them.

5. A method as recited in claim 4, wherein said step of forming an energy delivery device comprises forming a first insulation layer on the first die, forming a doped polysilicon layer on the first insulation layer, forming a conductive layer on the polysilicon layer, patterning the conductive layer into a desired form, patterning the polysilicon layer into resistive elements, and forming a second insulation layer over desired portions of the conductive layer and the polysilicon layer.

6. A method as recited in claim 5, wherein said step of forming a first insulation layer comprises growing a thermal oxide layer on the first die.

7. A method as recited in claim 5, wherein said step of forming a doped polysilicon layer comprises depositing polysilicon on the first insulation layer using an LPCVD process.

8. A method as recited in claim 5, wherein said step of forming a conductive layer comprises sputtering aluminum on the polysilicon layer.

9. A method as recited in claim 5, wherein said steps of patterning the conductive layer and patterning the polysilicon layer each comprise photolithographic etching.

10. A method as recited in claim 5, wherein said step of forming a mechanism comprises forming a secondary fluid channel through said first die.

11. A method as recited in claim 10, wherein said step of forming a primary fluid channel comprises forming a channel pattern in the second die, and attaching the second die to the first die with the channel pattern facing the energy delivery device.

12. A method as recited in claim 5, wherein said step of forming a mechanism comprises forming electrodes proximate the interface region.

13. A method as recited in claim 12, wherein said step of forming a primary fluid channel comprises forming a channel pattern in the second die, and attaching the second die to the first die with the channel pattern facing the energy delivery device.

* * * * *